US008715465B2

(12) United States Patent
Vyorykka et al.

(10) Patent No.: US 8,715,465 B2
(45) Date of Patent: May 6, 2014

(54) PAPER MAKING PROCESS USING BINDER/FILLER AGGLOMERATES

(75) Inventors: Jouko Vyorykka, Wädenswil (CH); Pekka Salminen, Freienbach (CH); Jonathan Budd, Horgen (CH)

(73) Assignee: Styron Europe GmbH, Horgen (CH)

( * ) Notice: Subject to any disclaimer, the term of this patent is extended or adjusted under 35 U.S.C. 154(b) by 8 days.

(21) Appl. No.: 13/203,322

(22) PCT Filed: Jan. 13, 2010

(86) PCT No.: PCT/US2010/020882

§ 371 (c)(1),
(2), (4) Date: Aug. 25, 2011

(87) PCT Pub. No.: WO2010/107512

PCT Pub. Date: Sep. 23, 2010

(65) Prior Publication Data

US 2011/0315333 A1 Dec. 29, 2011

Related U.S. Application Data

(60) Provisional application No. 61/160,855, filed on Mar. 17, 2009.

(51) Int. Cl.

| | |
|---|---|
| ***D21H 17/33*** | (2006.01) |
| ***D21H 17/55*** | (2006.01) |
| ***D21H 17/69*** | (2006.01) |

(52) U.S. Cl.

USPC ..... 162/168.2; 162/158; 162/181.1; 162/185; 162/168.1

(58) Field of Classification Search

USPC ..... 162/158, 164.1, 164.3, 164.5, 162/168.1–168.2, 169, 177, 185, 162/181.1–181.8; 525/50, 418, 420, 449, 525/523, 533

See application file for complete search history.

(56) References Cited

U.S. PATENT DOCUMENTS

| | | | | |
|---|---|---|---|---|
| 4,445,970 | A * | 5/1984 | Post et al. | 162/135 |
| 4,925,530 | A * | 5/1990 | Sinclair et al. | 162/164.1 |
| 5,157,084 | A * | 10/1992 | Lee et al. | 525/301 |
| 5,989,391 | A * | 11/1999 | Watanabe et al. | 162/164.5 |
| 6,586,520 | B1 | 7/2003 | Canorro et al. | |
| 7,074,845 | B2 * | 7/2006 | Laleg | 524/47 |
| 7,452,416 | B2 * | 11/2008 | Evers | 106/447 |
| 8,088,213 | B2 * | 1/2012 | Cheng et al. | 106/416 |
| 8,172,983 | B2 * | 5/2012 | Cheng et al. | 162/168.3 |
| 2006/0183816 | A1 * | 8/2006 | Gelman et al. | 523/201 |
| 2008/0041544 | A1 * | 2/2008 | Tsavalas et al. | 162/157.6 |
| 2009/0162642 | A1 * | 6/2009 | Ono et al. | 428/330 |

FOREIGN PATENT DOCUMENTS

| | | | |
|---|---|---|---|
| CN | 1411494 | A | 4/2003 |
| CN | 101370981 | A | 2/2009 |
| DE | 3730833 | A * | 3/1989 |
| JP | 2006-118093 | | 5/2006 |
| WO | WO 01/46323 | A1 | 6/2001 |
| WO | WO 2006/026283 | | 3/2006 |
| WO | WO 2006/086710 | | 8/2006 |

OTHER PUBLICATIONS

Machine translation of DE 3730833, The European Patent Office, [online], [retrieved on Dec. 28, 2012]. Retrieved from the Internet: <URL: http://worldwide.espacenet.com/?locale=EN_ep>.*

"Papermaking Additives", Kirk-Othmer Encyclopedia of Chemical Technology [online], 2011, [retrieved on Dec. 28, 2012]. Retrieved from the Internet: <URL: http://onlinelibrary.wiley.com/doi/10.1002/0471238961.1601160504211201.a01.pub2/pdf>.*

Notification of the First Office Action, Chinese Patent Application No. 201080012070.9, dated Feb. 26, 2013, p. 1-16, State Intellectual Property Office of the People's Republic of China, China.

* cited by examiner

*Primary Examiner* — Dennis Cordray
(74) *Attorney, Agent, or Firm* — Brinks Gilson & Lione

(57) ABSTRACT

A process for making paper, comprising contacting an anionic binder with a cationizing agent to make a cationized binder, contacting the cationized binder with an anionic pigment to form a binder/pigment agglomerate, contacting the agglomerate with an aqueous slurry of fibers, and forming a paper product from the slurry. The agglomerate may reduce the total cost of the paper product being produced while maintaining the strength of the paper at acceptable levels.

15 Claims, No Drawings

PAPER MAKING PROCESS USING BINDER/FILLER AGGLOMERATES

CROSS-REFERENCE TO RELATED APPLICATION

This application claims priority to PCT Application Serial No. PCT/US2010/020882 filed Jan. 13, 2010 published in English on Sep. 23, 2010 as PCT WO 2010/107512 and to U.S. Provisional App. No. 61/160,855 filed Mar. 17, 2009, the entire contents of each are incorporated herein by reference.

BACKGROUND OF THE INVENTION

This disclosure relates to a paper making process wherein a slurry of fibers is used to make a paper product.

Paper is primarily made using a process in which a slurry comprising cellulosic fibers is strained on a wire mesh to create a paper web, which is then further processed to form a paper product. However, fibers are relatively expensive. The industry has long sought ways to reduce the cost of paper by replacing some of the fiber with cheaper materials, such as inorganic pigments.

One drawback of replacing the fiber with pigment is that the paper product loses strength by doing so. It would be desirable to have a process for making paper that permits the substitution of fiber with pigment without substantial loss of paper strength.

SUMMARY OF THE INVENTION

In one embodiment, there is described herein an improved process comprising contacting an anionic binder with a cationizing agent under conditions sufficient to convert the anionic binder to a cationized binder, then contacting, in the substantial absence of fiber, the cationized binder with an anionic pigment to form a binder/pigment agglomerate, contacting the agglomerate, and optionally a retention aid and/or other additives, with an aqueous slurry of fibers, and forming a paper product from the slurry.

The process of preparing paper by using a cationized anionic binder of this disclosure instead of a cationized anionic pigment has many advantages. Due to the relatively small amount of binder that is used, the binder cationization process is easier to manage than a process for charge conversion of pigment, as large quantities of pigment are used in paper making (typically 10-20 wt %), thus making the process easier to implement by the paper industry. Additionally, the fact that there is a smaller amount of material that needs charge inversion contributes to the economical viability of the process.

Unexpectedly, the properties of paper prepared using a binder/pigment agglomerate prepared from a cationized binder are better than the properties of paper prepared using sequential addition of pigment, cationizing agent, and binder. While not wishing to be bound by any particular theory, it is thought that the agglomerate produced in the process of this disclosure has a surface that is not fully covered by anionic charges and thus the cationic surface of the cationized binder allows improved interaction with and retention onto anionic fibers and other binder/pigment agglomerates where an anionic surface is exposed. Due to the presence of a lower amount of catioinizing agent used in the wet end, the risk of the system becoming over-cationic is smaller and hence the pigment loading increase is not as limited as it is in systems where cationic pigments are used.

DETAILED DESCRIPTION OF THE INVENTION

For the purposes of the present disclosure, the term "dry" means in the substantial absence of water and the term "dry basis" refers to the weight of a dry material.

For the purposes of the present disclosure, the term "copolymer" means a polymer formed from at least 2 monomers.

As used herein, the term "paper" means paper products having a basis weight of not more than about 300 grams per square meter (gsm).

For the purposes of this disclosure, it is to be understood, consistent with what one of ordinary skill in the art would understand, that a numerical range is intended to include and support all possible subranges that are included in that range. For example, the range from 1 to 100 is intended to convey from 1.01 to 100, from 1 to 99.99, from 1.01 to 99.99, from 40 to 60, from 1 to 55, etc.

The present disclosure provides embodiments of a process that employs an anionic binder, a cationizing agent, an anionic pigment, and a fiber.

An anionic binder is employed in the disclosed process. A binder is employed that has sufficient adhesive or binding properties for use in the manufacture of paper. Examples of binders include, for example, styrene-butadiene latex, styrene-acrylate latex, styrene-butadiene-acrylonitrile latex, styrene-maleic anhydride latex, styrene-acrylate-maleic anhydride latex, acrylate latex, hollow particle latexes, agglomerated hollow particle latexes, polysaccharides, proteins, polyvinyl pyrrolidone, polyvinyl alcohol, polyvinyl acetate, cellulose derivatives, epoxyacrylates, polyesters, polyesteracrylates, polyurethanes, polyetheracrylates, polyolefin dispersions, oleoresins, nitrocellulose, polyamides, vinyl copolymers and various forms of polyacrylates. Examples of preferred binders include carboxylated styrene-butadiene latex, carboxylated styrene-acrylate latex, carboxylated styrene-butadiene-acrylonitrile latex, carboxylated styrene-maleic anhydride latex, carboxylated polysaccharides, proteins, polyvinyl alcohol, and carboxylated polyvinyl acetate latex. Examples of polysaccharides include agar, sodium alginate, and starch, including modified starches such as thermally modified starch, carboxymethylated starch, hydroxyethylated starch, and oxidized starch. Examples of proteins that can be suitably employed in the process of the present disclosure include albumin, soy protein, and casein. In one preferred embodiment, the binder is a styrene-butadiene latex. Several binders are widely commercially available. Mixtures of binders can be employed.

The anionic binder employed advantageously comprises a synthetic latex or a dispersion prepared from a preformed polymer, such as a dispersion of at least one polyolefin. A synthetic latex, as is well known, is an aqueous dispersion of polymer particles prepared by emulsion polymerization of one or more monomers. The latex can have a monomodal or polymodal, e.g. bimodal, particle size distribution. The latex can also have core shell structure.

One advantage of using an anionic latex as the starting material is the availability of a wide variety of anionic latexes, thereby allowing the paper manufacturer to achieve a wide range of targeted paper properties. In addition, the type and amount of cationizing agent can be selected to give a wide range of specific bonding to the anionic latex to provide the maximum strength, and the degree of cationizity can be adjusted to improve retention.

The anionic binder is employed in an amount sufficient to bind the components of the paper together. Advantageously, from about 2 to about 20 dry weight parts of anionic binder are employed per 100 dry weight parts of pigment, and preferably from about 3 to about 15 dry weight parts of anionic binder are employed.

The cationizing agent is a material that is employed in order to convert the negative surface charge of the anionic binder to a net positive charge. Cationic polymers are the preferred cationizing agents. Mixtures of cationizing agents can be employed.

Examples of cationic polymer cationizing agents include polyamidoamine-epihalohydrin polymers, polyalkyldiallylamine-epihalohydrin polymers, polyethyleneimine (hereinafter PEI), poly(dimethyl diallyl ammonium chloride), polyacrylamide, polyamine, polyvinylamine, and cationic starch. A preferred class of cationizing agent is polyamidoamine-epichlorohydrin polymers (hereinafter PAE). Other common names for PAE include: polyamide-epichlorohydrin, polyamidoamine-epichlorohdrin, polyamide(amine) epichlorohydrin, poly(aminoamide)-epichlorohydrin, polyaminopolyamide-epichlorohydrin, amino polyamide epichlorohydrin, polyalkylenepolyamide-epichlorohydrin.

As is well known, polyamidoamine-epihalohydrin polymer manufacturing processes typically involve reacting a polyamidoamine with an excess of epihalohydrin to convert amine groups in the polyamidoamine to epihalohydrin adducts. During the reaction, halohydrin groups are added at the secondary amine groups of the polyamidoamine. Many cationizing agents are commercially available. The cationizing agent may have cross-linking functionality. For example, polyamidoamine-epihalohydrin polymer has cross-linking functionality and is able to cross-link with carboxylic groups and hydroxyl groups. While not wishing to be bound by any theory, this functionality may strengthen the attachment of the agglomerate to fibers in the paper making process.

The amount of cationizing agent employed is an amount sufficient to convert the negative surface charge of the anionic binder to a net positive charge. A wide range of ratios of cationizing agent to binder can be employed. For example, as is well-known to those skilled in the art, in the case of a polymeric cationizing agent, the ratio depends strongly on the charge, charge density, molecular weight and conformation of the cationic polymer. Those skilled in the art also appreciate that the demand for cationizing agent depends strongly on the anionic latex surface charge and surface area as well as on the pH and electrolyte concentration. In the case of PAE resin, the dry weight ratio of cationizing agent to binder in various embodiments can be, for example, from less than 1:1 to about 1:5, or can be from less than 1:1 to about 1:3, or can be from about 0.9:1 to about 1:3, or can be from about 0.8:1 to about 1:3. In one embodiment, the dry weight ratio of PAE resin to binder can be less than 1:1, less than about 0.9:1, or less than about 0.8:1. In one embodiment, the dry weight ratio of PAE resin to binder can be at least about 1:5, at least about 1:4, or at least about 1:3.

In conjunction with cationic polymers, polyvalent compounds and monovalent metal compounds can be employed to increase the effectiveness of the cationic polymer. Polyvalent metal compounds, such as salts, are an example of a source of polyvalent cations. Any suitable polyvalent metal compound can be used in suitable form to assist in charge conversion of the anionic latex. Examples of polyvalent metals include Al, Ca, Mg, Co, Ti, Zr, V, Nb, Mn, Fe, Ni, Cd, Sn, Sb, Bi, and Zn. Examples of polyvalent metal compounds include various aluminum sulfate compounds (including, for example those compounds called "papermakers alum" or simply "alum"), such as $Al_2(SO_4)_3.18H_2O$, $Al_2(SO_4)_3.16H_2O$, and $Al_2(SO_4)_3$, .polyaluminum compounds or complexes, such as $Al_{12}(OH)_{24}AlO_4(H_2O)_{12}7^+$, iron compounds, such as $FeSO_4.7H_2O$ and $FeCl_3.6H_2O$, and alkaline earth metal compounds such as $MgCl_2$, $MgCO_3$ and $CaCl_2$, with the Al-containing compounds being preferred. Potassium sulfate compounds, such as $K_2SO_4.18H_2O$, are an example of monovalent metal compounds.

The disclosed process comprises contacting an anionic binder with a cationizing agent under conditions sufficient to convert the anionic binder to a cationized binder, i.e. a binder having a net positive charge. This can be accomplished in various ways, as is known to those skilled in the art. For example, either the charge of the anionic latex or the charge of the cationic polymer can be lowered or neutralized in the beginning of the process to make the two systems compatible. Once the systems are made compatible, the cationicity of the mixture is increased allowing stabilization and the presence of a net positive charge for the cationized latex. Typical methods of charge modification of polymers and dispersions can be employed to modify the pH of the system. Anionic binders, such as carboxylated latexes, tend to become more anionic at high pH while many cationic polymers with amino groups lose their cationic charge at high pH, while quaternary ammonium groups remain positively charged at high pH. It is possible to use additives or other polymers in a different stage of the charge conversion process to improve the process, stability or end use performance. For example, a source of polyvalent cations can be used to suppress the negative charge of the anionic latex, and the cationic polymer can be added thereafter to convert the charge to cationic and stabilize the cationized latex. Another example is to first use a cationic polymer that can convert the anionic latex to a cationized latex at lower addition levels, and thereafter another cationic polymer can be used to provide additional functionality, e.g. cross-linking and/or pH stability.

In one embodiment, the cationizing step sequentially employs two different polymeric cationizing agents. For example, the first cationic polymer can have positively charged groups that can be neutralized at lower pH. The second cationic polymer can be added after charge conversion of the anionic binder with the first polymer, and can be selected to, for example, increase the positive charge, bring new functionalities (e.g. cross-linking), or allow a wider operative pH range (e.g. quaternary ammonium groups) making the system highly charged in alkaline paper making conditions.

Advantageously, prior to contact with the binder, the pH of the cationizing agent is raised to reduce the cationicity of the cationizing agent. In certain embodiments, such as, for example when using PEI as the cationizing agent, the pH can be adjusted to be at least 8 or at least about 9. In one embodiment, the pH is adjusted to be at least about 11. The pH adjustment advantageously is conducted using a base. Bases are well known materials and several are commercially available. NaOH is an example of a base.

Advantageously, prior to being contacted with the cationizing agent, the binder is diluted to achieve a reduced solids content. This is done primarily in order to reduce the viscosity of the cationized latex. In one embodiment, the solids of the binder is adjusted by adding water to the binder in an amount sufficient to achieve a diluted solids content of from about 10 to about 25 percent solids or, in another embodiment, from about 11 to about 15 percent solids.

The diluted binder and the pH-adjusted cationizing agent are contacted to form a mixture. In one embodiment, the diluted binder and pH-adjusted cationizing agent are contacted under conditions such that the resulting mixture is a homogeneous aqueous dispersion of a cationized binder. In one embodiment, for example, the diluted binder is added to the pH-adjusted cationizing agent with mixing.

In one embodiment, the pH of the mixture of diluted binder and pH-adjusted cationizing agent is lowered to increase the cationic charge of the system and convert the binder to a cationic binder. The pH of the mixture can be lowered with an acid. Many acids are commercially available. Examples of acids include HCl, $H_2SO_4$ and citric acid. In one embodiment, the pH is lowered to less than about 5. For example, the pH of the mixture can be decreased to 3.5 with an aqueous solution of 10% hydrochloric acid (HCL) to give a cationized binder.

In one embodiment, additional cationizing agent, which can be the same as or different than the cationizing agent used to prepare the cationized binder, optionally can be added to the cationized binder at this point or it optionally can be added to the paper furnish. Alum is a common additive in paper making. For example, 0.85 wt % alum can be added to the cationized binder. Polyalyminium chloride is an example of another material that can be used.

The pigment, or filler, employed comprises anionic particles. In one embodiment, the pigment is predominantly inorganic. Advantageously, the pigment comprises at least one substance selected from aluminium hydroxide, aragonite, barium sulphate, calcite, calcium sulphate, gypsum, dolomite, magnesium hydroxide, magnesium carbonate, magnesite, calcium carbonate, ground calcium carbonate, precipitated calcium carbonate, titanium dioxide (e.g. rutile and/or anatase), satin white, zinc oxide, silica, alumina trihydrate, mica, talc, clay, kaolin, calcined clay, diatomaceous earth, and vaterite or any combination thereof. Preferred pigments include calcium carbonate in any suitable form, kaolin, titanium dioxide in any suitable form, and calcium sulphate, with ground calcium carbonate, precipitated calcium carbonate being more preferred. Mixtures of pigments can be employed. In one embodiment, polymeric, or plastic, pigments, such as polystyrene particles in latex form, comprise a portion of the pigment. A wide variety of pigments are commercially available.

The amount of pigment used can vary widely. The pigment can have several functions in paper making, including lowering the cost and improving the optical properties of the paper. In various embodiments, the amount of pigment employed is from about 10 to about 80 weight percent of the weight of the final paper product, or is from about 20 to about 60 weight percent of the weight of the final paper product.

The process further comprises contacting the cationized binder with an anionic pigment to form a binder/pigment agglomerate. In one embodiment, this contacting is accomplished by adding the cationized binder to a slurry of the anionic pigment. The contacting can be accomplished in the substantial absence of fiber. Preferably, the contacting is conducted in a manner such that the resulting mixture is a homogeneous aqueous dispersion of the agglomerate. The formation of the agglomerates can be controlled by factors well known to those skilled in the art including, for example, speed of mixing, viscosity, speed of addition, and mixer type and configuration.

The agglomerate of cationized binder and anionic pigment can be referred to as a "hetero-agglomerate," since one of its components is a cationized binder and the other is anionic pigment.

The agglomerate is employed in an amount sufficient to bind at least some of the fibers into a paper web. Advantageously, from about 5 to about 70 weight percent of the agglomerate is employed in the final paper, and preferably from about 10 to about 50 weight parts of agglomerate is employed.

The agglomerate can be used to prepare paper products, such as paperboard, and paper for printing, writing or packaging, by using the agglomerate under conventional papermaking conditions. In one embodiment, the product is substantially free of mineral wool, perlite, or both. In one embodiment, paper products do not include ceiling tile or flooring felt, as ceiling tile or flooring felt typically have a basis weight of greater than 300 gsm.

The processes and materials involved in making paper, including the choice of fibers that can be employed, are well-known to those skilled in the art. In one embodiment, the fibers employed are predominantly cellulosic fibers.

Advantageously, the agglomerate of the disclosure allows the use in the paper making process of a higher amount of pigment relative to fiber. For example, it is possible to replace from about 5 to about 70 dry weight percent of the fiber in a paper formulation with the agglomerated pigment of the disclosure.

If desired, one or more conventional additives may be incorporated into the compositions of the disclosure in order to modify the properties thereof. Examples of these additives include conventional thickeners, dispersants, dyes and/or colorants, biocides, anti-foaming agents, optical brighteners, wet strength agents, lubricants, water retention agents, cross-linking agents, surfactants, and the like.

SPECIFIC EMBODIMENTS OF THE INVENTION

The following examples are given to illustrate the invention and should not be construed as limiting in scope. All parts and percentages are by weight unless otherwise indicated.

Test Methods

Tensile Strength

Tensile strength measurements are performed with an Instron 3365 (available from Illinois Tool Works Inc., Massachusetts, USA using the following settings:

speed=25 mm/min distance between clamps: 6 cm sample length: 75 mm sample width at the end: 10 mm sample width in the middle: 5 mm The sample thickness is analyzed from multiple points of the specimen. The lowest thickness (weakest point) is used for calculating the tensile stress at maximum load (reported in $N/mm^2$) Another reported value is maximum load (reported in N).

Materials

The following materials are used in the examples.

Pigment A: a dispersion of natural ground calcium carbonate with particle size of 85%<2 μm in water (Hydrocarb® HO-ME 65 available from Omya, Oftringen, Switzerland), 65% solids.

Latex A: carboxylated styrene-butadiene latex (DL 945 available from The Dow Chemical Company, Midland, Mich., USA), 50% solids in water. Latex A has an average particle size of 130 nm and glass transition temperature of 6° C.

Cationic Latex B: Cationically polymerized styrene-butadiene latex. Cationic Latex B has an average particle size of 140 nm and a Tg of −0.7° C. The Zeta potential of the latex is 17.9 mV at pH 7.0.

PAE resin: cationic polyamidoamine-epichlorohydrin resin (Kymene 920, available from Hercules GmbH, Germany)

Fixative: Catiofast VHF (available from BASF, Germany)

Flocculant: Polymin 540 (available from BASF, Germany)

Alum: Aluminum sulfate hexadecahydrate ($Al_2(SO_4)_3.16H_2O$) (available from Sigma Aldrich, Switzerland).

Hardwood fibers: Jariliptus (available from Jari Celullose S.A., Brazil)

Softwood fibers: Botnia long fiber softwood pulp (available from Oy Metsä-Botnia AB, Finland)

Example 1

Preparation of a Cationized Binder

Two cationic latex binder systems, designated Cationized Latex 1:1 and Cationized Latex 3:1, respectively, are prepared using the formulations described in Table 1. Latex A is diluted with water to achieve final solids of 12 wt %. The pH of Kymene 920 is increased to 11 with NaOH. The diluted latex is added slowly to the Kymene 920 while mixing with a magnetic stirrer. The pH of the resulting mixture is decreased to 3.5 with 10% hydrochloric acid to make the system cationic. Then, 0.85 wt % (dry/dry) Alum ($Al_2(SO_4)_3.16H_2O$) is added to the cationized latex mixture.

TABLE 1

Recipes for Cationized Latexes (dry weight parts)

| Component | Cationized Latex 1:1 | Cationized Latex 3:1 |
|---|---|---|
| Kymene 920 | 100 | 100 |
| DL 945 | 100 | 300 |
| Alum | 1.1 | 1.1 |
| pH | 3.5 | 3.5 |
| Solids [%] | 12 | 12 |

Example 2

Preparation of Binder/Pigment Agglomerate

Pigment A is diluted to reach a final solids content of 12%. Various latexes are added to the slurry of Pigment A while mixing with a magnetic stirrer. The mixture is stirred for 16 hours. The amounts of each component in making agglomerates are shown in Table 2. The two hetero-agglomerates are designated HeC 945 1:1 and HeC 945 3:1, respectively, and are prepared using the cationized latexes of Example 1. For comparison purposes, one agglomerate, which is designated B 35:3 is prepared using Cationic Latex B.

TABLE 2

Recipes for Agglomerates

| Component | B 35:3 | HeC 945 1:1 | HeC 945 3:1 |
|---|---|---|---|
| Pigment A | 100 | 100 | 100 |
| Cationic latex B 35:3 | 8.6 | | |
| Cationized Latex 1:1 | | 6.7 | |
| Cationized Latex 3:1 | | | 6.7 |
| Solids content [%] | 12 | 12 | 12 |

Reference Example 3

Preparation of Reference Paper (Not an Embodiment of the Invention)

Pulp is disintegrated with a pulp disintegrator (type 967, Karl Frank GmbH) to a consistency of 2%. The beating is performed with laboratory beater (type 3-3, Lorentzen Wettre). The beating of Jariliptus pulp is done to Shopper-Riegler 30° and the Botnia pulp is beat to Shopper-Riegler 25°. The pulp is mixed in a 70:30 ratio (Jariliptus:Botnia) and the consistency, or solids, is set to 0.5%. The fixative Catiofast VHF is diluted to 1 wt % with tap water. Polymin 540 is diluted to 0.05 wt % with tap water (drop by drop addition while mixing). The formulation for hand sheet preparation is described in Table 3. The time between each step is about 10 s.

The following addition sequence to the mixer is utilized in the procedure of the preceding paragraph:

1. Add fiber mixture
2. Add diluted Fixative Catiofast VHF
3. Add Pigment A
4. Add diluted latex (optional, only in Comparative Experiment 4)
5. Add diluted Flocculant Polymin 540
6. Add full formulation into the sheet former Hand sheets are made using the formulations prepared as described in this example with a sheet former (type 853, Karl Frank GmbH). The drying time is approximately 10 min at 96° C. The target weight of a handsheet is 2.55 g. The retention of pigment and other components is calculated by comparing the actual weight to the target weight. To simplify the analysis all the lost weight is reduced from the added filler amount to obtain the "Actual Filler %" given in Table 12. The properties of the resulting paper and the papers prepared in the following examples and comparative experiments are given in Table 12.

TABLE 3

Reference Formulation without any Polymeric Binder

| | parts | dry weight [g] | solids, % | wet weight [g] |
|---|---|---|---|---|
| Fiber mix | 79.88 | 2.037 | 0.49 | 415.70 |
| Pigment A | 20 | 0.510 | 60 | 0.850 |
| Catiofast VHF | 0.08 | 0.002 | 0.222 | 0.919 |
| Latex | 0 | 0 | | 0 |
| Polymin 540 | 0.04 | 0.001 | 0.022 | 4.636 |
| Target weight [g] | | 2.550 | | |

Comparative Experiment 4

Preparation of Comparative Paper (Not an Embodiment of the Invention)

The procedure of Example 3 is repeated, except that the formulation of Table 4 is employed, and PAE resin is added between Step 3 (Pigment A) and Step 4 (Latex).

TABLE 4

Comparative Formulation with Sequential Addition of Cationic PAE resin and Latex.

| | parts | dry weight [g] | solids, % | wet weight [g] |
|---|---|---|---|---|
| Fiber mix | 67.92 | 1.732 | 0.48 | 360.83 |
| Pigment A | 30 | 0.765 | 54.77 | 1.397 |
| Catiofast VHF | 0.06 | 0.002 | 0.222 | 0.689 |
| Latex A | 1 | 0.026 | 12 | 0.2125 |
| PAE resin | 1 | 0.026 | 12 | 0.2125 |
| Polymin 540 | 0.02 | 0.001 | 0.022 | 2.318 |
| Target weight [g] | | 2.550 | | |

Comparative Experiment 5

Preparation of Comparative Paper (Not an Embodiment of the Invention)

The procedure of Example 3 is repeated, except that the formulation of Table 5 is employed, and "Cationized Latex 1:1" is used instead of Latex A.

TABLE 5

Comparative Formulation with Sequential Addition of Pigment And Cationized Latex to the Fiber Mix.

| | parts | dry weight [g] | solids, % | wet weight [g] |
|---|---|---|---|---|
| Fiber Mix | 67.92 | 1.732 | 0.5 | 346.39 |
| Pigment A | 30 | 0.765 | 53.53 | 1.429 |
| Catiofast VHF | 0.06 | 0.002 | 0.222 | 0.689 |
| Cationized Latex 1:1 | 2 | 0.051 | 12 | 0.425 |
| Polymin 540 | 0.02 | 0.001 | 0.022 | 2.318 |
| Target weight [g] | | 2.550 | | |

Comparative Experiment 6

Preparation of Comparative Paper (Not an Embodiment of the Invention)

The procedure of Example 3 is repeated, except that the formulation of Table 6 is employed, and cationically polymerized Cationic Latex B is added in Step 4.

TABLE 6

Comparative Formulation with Cationically Polymerized Latex instead of Anionic Latex

| | parts | dry weight [g] | solids, % | wet weight [g] |
|---|---|---|---|---|
| Fiber mix | 67.83 | 1.730 | 0.5 | 345.93 |
| Pigment A | 30 | 0.765 | 53.53 | 1.429 |
| Catiofast VHF | 0.13 | 0.003 | 0.222 | 1.493 |
| Cationic latex B | 2 | 0.051 | 12 | 0.425 |
| Polymin 540 | 0.04 | 0.001 | 0.022 | 4.636 |
| Target weight [g] | | 2.550 | | |

Comparative Experiment 7

Preparation of Comparative Paper (Not an Embodiment of the Invention)

The procedure of Example 3 is repeated, except that the formulation of Table 7 is employed, and comparative agglomerate B 35:3 (as described in Table 2) is added between Step 2 (Fixative) and Step 5 (Flocculant), and there is no addition of Pigment A or Latex A.

TABLE 7

Comparative Formulation with Agglomerate from Cationically Polymerized Latex

| | parts | dry weight [g] | solids, % | wet weight [g] |
|---|---|---|---|---|
| Fiber Mix | 61.92 | 1.579 | 0.5 | 315.79 |
| Pigment A | 0 | 0 | | 0 |

TABLE 7-continued

Comparative Formulation with Agglomerate from Cationically Polymerized Latex

| | parts | dry weight [g] | solids, % | wet weight [g] |
|---|---|---|---|---|
| Catiofast VHF | 0.06 | 0.002 | 0.222 | 0.689 |
| B 35:3 | 38 | 0.969 | 12 | 8.075 |
| Polymin 540 | 0.02 | 0.001 | 0.022 | 2.318 |
| Target weight [g] | | 2.550 | | |

Example 8

The procedure of Example 3 is repeated, except that agglomerate HeC 945 1:1 is added between Step 2 (Fixative) and Step 5 (Flocculant), and there is no addition of Pigment A or Latex A.

TABLE 8

Inventive Formulation with Hetero-Agglomerate.

| | parts | dry weight [g] | solids, % | wet weight [g] |
|---|---|---|---|---|
| Fiber mix | 67.92 | 1.732 | 0.52 | 333.07 |
| Pigment A | 0 | 0 | | 0 |
| Catiofast VHF | 0.06 | 0.002 | 0.222 | 0.689 |
| HeC 945 1:1 | 32 | 0.816 | 12 | 6.8 |
| Polymin 540 | 0.02 | 0.001 | 0.022 | 2.318 |
| Target weight [g] | | 2.550 | | |

Example 9

The procedure of Example 8 is repeated, except that the formulation of Table 9 is employed. The agglomerate level is increased in this example.

TABLE 9

Inventive Formulation with Hetero-Agglomerate.

| | parts | dry weight [g] | solids, % | wet weight [g] |
|---|---|---|---|---|
| Fiber mix | 63.9 | 1.629 | 0.5 | 325.89 |
| Pigment A | 0 | 0 | | 0 |
| Catiofast VHF | 0.04 | 0.001 | 0.222 | 0.459 |
| HeC 945 1:1 | 36 | 0.918 | 11.2 | 8.20 |
| Polymin 540 | 0.06 | 0.002 | 0.022 | 6.955 |
| Target weight [g] | | 2.550 | | |

Example 10

The procedure of Example 9 is repeated, except that the formulation of Table 10 is employed. The agglomerate level is further increased in this example.

TABLE 10

Inventive Formulation with Hetero-Agglomerate.

| | parts | dry weight [g] | solids, % | wet weight [g] |
|---|---|---|---|---|
| Fiber mix | 59.86 | 1.526 | 0.53 | 288.01 |
| Pigment A | 0 | 0 | 49 | 0 |

TABLE 10-continued

Inventive Formulation with Hetero-Agglomerate.

| | parts | dry weight [g] | solids, % | wet weight [g] |
|---|---|---|---|---|
| Catiofast VHF | 0.08 | 0.002 | 0.222 | 0.919 |
| HeC 945 1:1 | 40 | 1.020 | 11.2 | 9.11 |
| Polymin 540 | 0.06 | 0.002 | 0.022 | 6.955 |
| Target weight [g] | | 2.550 | | |

Example 11

The procedure of Example 8 is repeated, except that the formulation of Table 11 is employed. In this example the agglomerate employed is HeC 945 3:1, which is prepared using a cationized latex with a lower (1:3) ratio of PAE resin to anionic latex; thus, the cationicity of the agglomerate is decreased compared to HeC 945 1:1.

TABLE 11

Inventive Formulation with Hetero-Agglomerate.

| | parts | dry weight [g] | solids, % | wet weight [g] |
|---|---|---|---|---|
| Fiber mix | 67.88 | 1.731 | 0.56 | 309.10 |
| Pigment A | 0 | 0 | | 0 |
| Catiofast VHF | 0.06 | 0.002 | 0.222 | 0.689 |
| HeC 945 3:1 | 32 | 0.816 | 12 | 6.80 |
| Polymin 540 | 0.06 | 0.002 | 0.022 | 6.955 |
| Target weight [g] | | 2.550 | | |

TABLE 12

Properties of Paper Prepared with Hand Sheet Former Utilizing Formulations Described in Tables 3 to 11.

| Ref. | Target filler [%] | Target Polymer [%] | Sheet weight [g] | Actual filler [%] | Maximum load [N] | Tensile stress at max load [N/mm2] |
|---|---|---|---|---|---|---|
| Ref. Ex. 3 | 20.0 | 0 | 2.54 (±0.01) | 19.6 (±0.6) | 10.6 (±1.0) | 15.7 (±0.8) |
| C. Ex. 4 | 30.0 | 2.0 | 2.49 (±0.02) | 27.7 (±0.9) | 9.6 (±0.7) | 15.0 (±1.1) |
| C. Ex. 5 | 30.0 | 2.0 | 2.43 (±0.01) | 25.3 (±0.6) | 9.1 (±0.3) | 14.9 (±0.7) |
| C. Ex. 6 | 30 | 2 | 2.54 (±0.01) | 29.4 (±0.2) | 6.6 (±0.6) | 10.5 (±0.5) |
| C. Ex. 7 | 35 | 3 | 2.49 (±0.01) | 32.6 (±0.6) | 5.1 (±0.2) | 8.4 (±0.2) |
| Ex. 8 | 30.0 | 2.0 | 2.49 (±0.01) | 27.6 (±0.6) | 11.9 (±0.5) | 19.1 (±0.2) |
| Ex. 9 | 33.7 | 2.3 | 2.52 (±0.02) | 32.4 (±0.6) | 9.3 (±1.1) | 14.4 (±1.2) |
| Ex. 10 | 37.5 | 2.5 | 2.50 (±0.02) | 35.4 (±0.7) | 6.1 (±0.6) | 10.4 (±0.9) |
| Ex. 11 | 30 | 2.0 | 2.54 (±0.02) | 29.5 (±0.6) | 8.5 (±0.6) | 13.6 (±0.5) |

Table 13 summarizes the properties of paper made in the Comparative Experiments, the Examples, and Reference Example 3. The data is calculated from Table 12. The Normalized Strength and Filler increase values are in percentage units to show the percentage increase vs. the Reference Example. The Normalized strength is calculated from Tensile Stress values given in Table 12. The Fiber replacement values are in weight percentage and are calculated from the Actual filler weight percentage (Actual Filler %-Actual Filer % of Ref. Ex 3).

TABLE 13

Comparison of Comparative data and Inventive Examples to Reference data from Table 12.

| Ref. | Normalized strength [%] | Filler increase [%] | Fiber replacement [wt %] |
|---|---|---|---|
| Ref. Ex. 3 | 100 | 0 | 0 |
| C. Ex. 4 | 96 | 41 | 8 |
| C. Ex. 5 | 95 | 29 | 6 |
| C. Ex. 6 | 67 | 50 | 10 |
| C. Ex. 7 | 54 | 66 | 13 |
| Ex. 8 | 122 | 41 | 8 |
| Ex. 9 | 92 | 65 | 13 |
| Ex. 10 | 66 | 81 | 16 |
| Ex. 11 | 87 | 50 | 10 |

Examples 8-11 demonstrate fiber replacement of between 8-16 wt % when compared to the Reference sample. These experimental results demonstrate that the filler level can be increased from 20 wt % to over 30 wt % in paper by using the agglomerate of this disclosure to maintain strength values.

Comparative Experiment 4 gives very similar strength to Reference Example 3, allowing 8 wt % fiber replacement by filler. Comparative Experiment 5, where cationized latex is added after calcium carbonate, gives strength values close to that of Reference Example 3, but allows only 6 wt % fiber replacement by filler and hence proves to be a worse approach than that of Comparative Experiment 4.

Comparative Experiments 6 and 7 demonstrate the use of cationically polymerized latex. These demonstrate relatively high filler retention, but the strength values are unacceptable low.

Example 8 demonstrates higher strength values than Reference Example 3, even though 8 wt % of the fibers are replaced with agglomerated fillers. Comparing the results of Ex. 8 to those of Comparative Experiment 4 shows that for equivalent fiber replacement, Ex. 8 gives unexpectedly superior strength.

Example 9 demonstrates an even higher degree of fiber replacement (13 wt %) and the strength values are fairly close to those of Reference Example 3. Comparing the results of Ex. 9 to those of Comparative Experiment 7 shows that for equivalent fiber replacement, Ex. 9 gives unexpectedly superior strength.

Example 10 demonstrates the highest fiber replacement percentage (16 wt %). The strength is lowered due to the high filler loading while keeping the binder amount low. However, Example 10 demonstrates clearly superior strength versus Comparative Experiment 7, which had a lower filler level.

Example 11 demonstrates strength that is 87% of the Reference value, but allows 10 wt % fiber replacement, even when the amount of PAE resin is significantly reduced. Comparing the results of Ex. 11 to those of Comparative Experiment 6 shows that for equivalent fiber replacement, Ex. 11 gives unexpectedly superior strength.

What is claimed is:

1. A process comprising contacting an anionic binder comprising a synthetic latex with a cationizing agent under conditions sufficient to convert the anionic binder to a cationized binder, wherein the contacting of the anionic binder comprising the synthetic latex with the cationizing agent occurs in the absence of anionic pigments, further wherein the cationizing agent is a polyamidoamine-epihalohydrin polymer, then contacting, in the substantial absence of fiber, the cationized binder with an anionic pigment to form a binder/pigment agglomerate, contacting the agglomerate with an aqueous slurry of fibers, and forming a paper product from the slurry.

2. The process of claim 1 wherein the cationizing agent has cross-linking functionality.

3. The process of claim 1 wherein the dry weight ratio of cationizing agent to binder is from less than about 1:1 to about 1:3.

4. The process of claim 1 wherein at least two different cationizing agents are used.

5. The process of claim 1 wherein the cationizing agent is a polyamidoamine-epichlorohydrin polymer.

6. The process of claim 1 wherein the paper product is printing paper or writing paper.

7. A process comprising contacting an anionic latex with a polyamidoamine-epichlorohydrin polymer under conditions sufficient to convert the anionic latex to a cationized latex, then contacting, in the substantial absence of fiber, the cationized latex with an anionic pigment to form a latex/pigment agglomerate, contacting the agglomerate, and optionally a retention aid, with an aqueous slurry of fibers and forming a paper product from the slurry.

8. A paper product prepared via the process of claim 1.

9. The process of claim 1, further comprising contacting a retention aid and/or other additives with the aqueous slurry of fibers.

10. The process of claim 1 wherein between about 2 and about 20 dry weight parts of the anionic binder are employed per 100 dry weight parts of the anionic pigment.

11. The process of claim 1 wherein the dry weight percent of the binder/pigment agglomerate in the paper product is from about 5 to about 70.

12. The process of claim 1, further comprising adjusting a pH of the cationizing agent to at least about 8 prior to contacting the anionic binder with the cationizing agent.

13. The process of claim 1, further comprising adjusting a pH of the contacted anionic binder and cationizing agent to less than about 5 to convert the anionic binder to the cationized binder.

14. The process of claim 1, wherein contacting the cationized binder with the anionic pigment comprises adding the cationized binder to a slurry comprising the anionic pigment.

15. The process of claim 1, wherein the anionic binder comprises from about 10 weight percent to about 20 weight percent solids content during contacting with the cationizing agent.

* * * * *